US007983593B2

(12) United States Patent
Yamauchi et al.

(10) Patent No.: US 7,983,593 B2
(45) Date of Patent: Jul. 19, 2011

(54) IMAGE FORMING APPARATUS

(75) Inventors: Hirokazu Yamauchi, Kyoto (JP); Masato Kuze, Kyoto (JP); Kohji Wakamoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 160 days.

(21) Appl. No.: 12/425,680

(22) Filed: Apr. 17, 2009

(65) Prior Publication Data

US 2009/0263161 A1 Oct. 22, 2009

(30) Foreign Application Priority Data

Apr. 21, 2008 (JP) ..... 2008-110339

(51) Int. Cl.

*G03G 15/00* (2006.01)
*G03G 15/04* (2006.01)
*G03G 15/06* (2006.01)
*G03G 15/08* (2006.01)

(52) U.S. Cl. ..... 399/107; 399/177; 399/222; 399/262

(58) Field of Classification Search ..... 399/118, 399/177, 107, 222, 119, 258, 262, 401
See application file for complete search history.

(56) References Cited

U.S. PATENT DOCUMENTS

| | | | | |
|---|---|---|---|---|
| 5,083,170 | A * | 1/1992 | Sawada et al. | 399/401 |
| 5,132,742 | A * | 7/1992 | Goto | 399/401 |
| 5,298,952 | A * | 3/1994 | Kamijo et al. | 399/262 |
| 5,839,032 | A * | 11/1998 | Yasui et al. | 399/401 |
| 7,133,628 | B2 * | 11/2006 | Yamamoto et al. | |
| 7,379,688 | B2 | 5/2008 | Kikkawa | |
| 2004/0165921 | A1 * | 8/2004 | Miura | 399/401 |
| 2005/0019067 | A1 * | 1/2005 | Kang et al. | 399/401 |
| 2006/0093401 | A1 * | 5/2006 | Tanda | 399/258 |
| 2006/0204282 | A1 | 9/2006 | Yoshida et al. | |
| 2006/0239734 | A1 * | 10/2006 | Ohtsuki | 399/401 |
| 2008/0253810 | A1 * | 10/2008 | Tateyama et al. | 399/258 |

FOREIGN PATENT DOCUMENTS

| | | |
|---|---|---|
| JP | 61-132921 | 6/1986 |
| JP | 01-259385 | 10/1989 |
| JP | 10-301380 | 11/1998 |
| JP | 10-319820 | 12/1998 |
| JP | 2006-251286 A | 9/2006 |
| JP | 2007-052352 | 3/2007 |

OTHER PUBLICATIONS

Office Action for corresponding Japanese Application No. 2008-110339 dated Mar. 16, 2010.
Japanese Office Action for corresponding Japanese Application No. 2008-110339 dated Oct. 12, 2010.

* cited by examiner

*Primary Examiner* — Susan S Lee
(74) *Attorney, Agent, or Firm* — Renner, Otto, Boisselle & Sklar, LLP

(57) ABSTRACT

An image forming apparatus including: a cylindrical photoconductor; a laser scanning section for forming an electrostatic latent image on a peripheral surface of the photoconductor; an image development section for developing the electrostatic latent image by using a toner; a toner storage section for storing the toner to be supplied; and a transfer section for transferring the visualized image with use of the toner onto a printing sheet, wherein the image development section is disposed upstream of a rotation direction of the photoconductor from the transfer section, the toner storage section is disposed above the image development section while having a predetermined distance from the image development section so as to form a space therebetween for releasing heat, and the laser scanning section emits the scanning beam obliquely upwardly with respect to a horizontal direction so that the emitted scanning beam passes through the space and exposes the peripheral surface.

3 Claims, 6 Drawing Sheets

IMAGE FORMING APPARATUS

CROSS-REFERENCE TO RELATED APPLICATION

This application is related to Japanese Patent Application No. 2008-110339 filed on Apr. 21, 2008, whose priority is claimed and the disclosure of which is incorporated by reference in its entirety.

BACKGROUND OF THE INVENTION

1. Field of the Invention

The present invention relates to an image forming apparatus, and more particularly relates to an arrangement of a photoconductor, an image development section, a toner storage section, and a laser scanning section which are used for an electrophotographic process in an image forming apparatus.

2. Description of the Background Art

In recent years, along with downsizing of an image forming apparatus, a diameter of a photoconductor drum used for an electrophotographic process is also being downsized. In the case of the apparatus having a medium-speed/low-speed, a photoconductor drum having a diameter of about 30 mm is generally used. This tendency stems from demands for lowering in cost, resource saving, and the like. In addition, characteristics of photoconductor materials and progress in the electrophotographic process technology enables the downsizing.

On the other hand, the image forming apparatus is becoming increasingly sophisticated and even in the case of the apparatus having the medium-speed/low-speed, an automatic duplex printing function is provided as a matter of course, which results from demands for energy saving.

Further, due to the downsizing of the apparatus, proposed is a layout that allows a printing sheet to be fed in a vertical direction (e.g., see Japanese Unexamined Patent Application No. 2006-78575).

Still further, proposed is an arrangement of a scanning device that exposes the photoconductor drum, the scanning device exposing an off-center portion of the photoconductor with a laser beam (e.g., see description relating to the conventional means in Japanese Unexamined Patent Application No. H61-132921).

Along with the downsizing of the diameter of the photoconductor drum, stations executing respective processes relating to the electrophotographic process such as electrostatic charging, developing, transferring, cleaning, and the like are densely arranged in the vicinity of the photoconductor.

On the other hand, when the duplex printing is performed on a large number of printing sheets, a printing sheet, whose first surface is heated at the time of printing, comes into contact with the photoconductor at the time of performing transfer onto a second surface of the printing sheet, and consequently the photoconductor drum is heated gradually. The heat conducted to the photoconductor drum is then conducted to the image development section which is in contact with the photoconductor drum, and consequently there may be a case where toner particles are agglomerated in the image development section. In order to prevent such a situation, it is preferable to create an airflow to release the heat.

SUMMARY OF THE INVENTION

The present invention is invented in view of the above-described disadvantage, and the present invention provides an image forming apparatus which realizes downsizing, and which is capable of effectively releasing heat from the photoconductor and the image development section.

The present invention provides an image forming apparatus including: a cylindrical photoconductor used for image formation in an electrophotographic process; a laser scanning section for exposing a peripheral surface of the photoconductor to a scanning beam so as to form an electrostatic latent image thereon; an image development section for developing the electrostatic latent image by using a toner; a toner storage section for storing the toner to be supplied to the image development section; a vertical transport path configured to pass a printing sheet therethrough while the printing sheet comes into contact with a part of the peripheral surface of the photoconductor; and a transfer section for transferring an image that is visualized by the image development section with use of the toner from the peripheral surface of the photoconductor onto the printing sheet, wherein the image development section is disposed in contact with the peripheral surface upstream of a rotation direction of the photoconductor from the transfer section, the toner storage section is disposed above the image development section while having a predetermined distance from the image development section so as to form a space therebetween for releasing heat, and the laser scanning section emits the scanning beam obliquely upwardly with respect to a horizontal direction so that the emitted scanning beam passes through the space, reaches the peripheral surface, and exposes the peripheral surface.

DETAILED DESCRIPTION OF THE PREFERRED EMBODIMENTS

Figure 1:
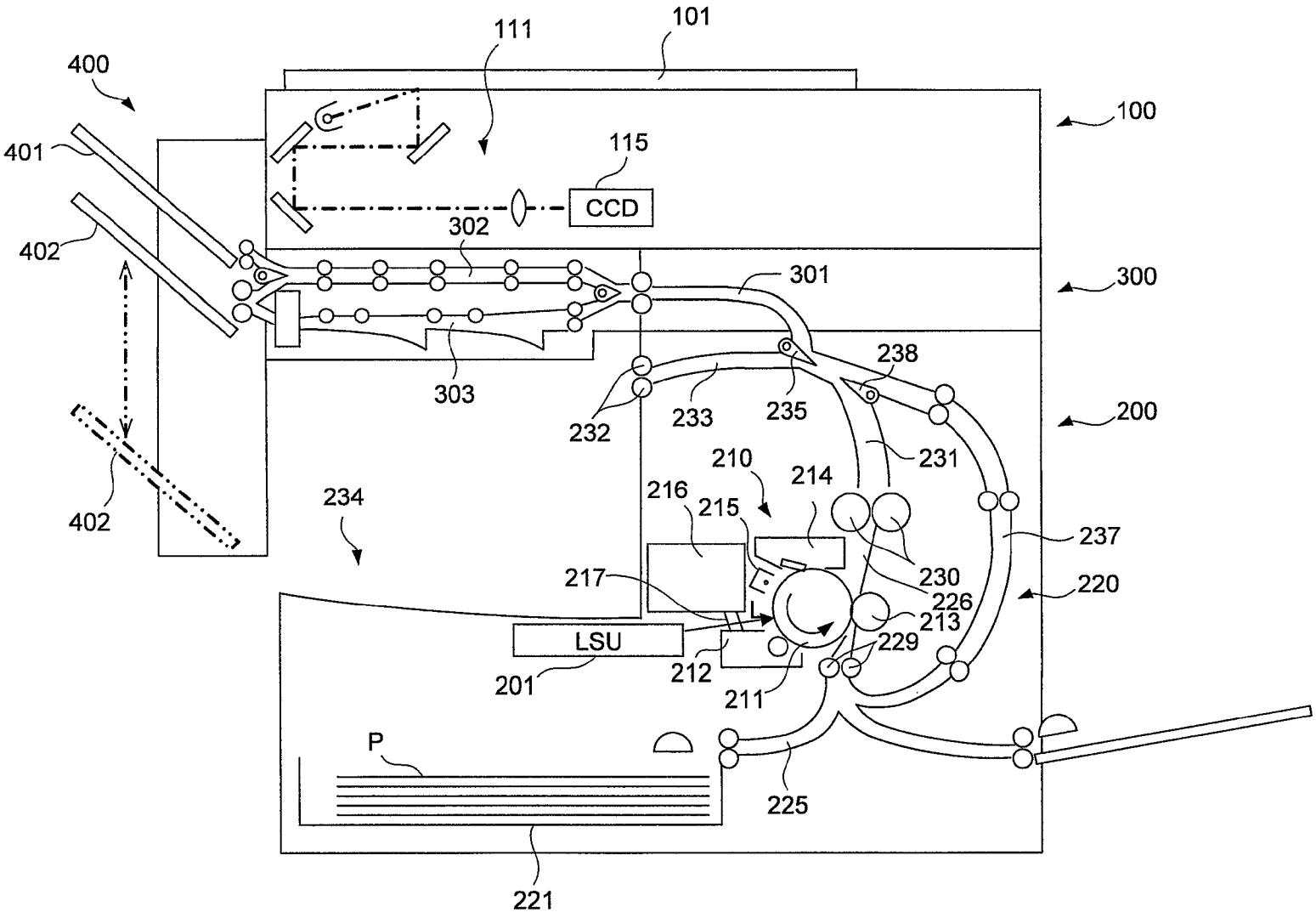
FIG. 1 is a diagram schematically showing an entire configuration of an image forming apparatus of the present invention.

In the image forming apparatus of the present invention, the toner storage section is separated from the image development section by a predetermined distance so as to form a space for heat releasing therebetween. Accordingly, it is possible to effectively release the heat from the image development section, and also possible to create an airflow toward the photoconductor where various peripheral stations are arranged densely. Further, since the laser scanning section emits the scanning beam, through the space, onto the outer circumferential surface, and exposes the outer circumferential surface to the scanning beam, then the space is effectively used as an optical path through which the scanning beam passes, whereby downsizing of the apparatus can be realized.

Further, the toner storage section is disposed above the image development section, and the laser scanning section emits the scanning beam obliquely upward with respect to the horizontal direction so as to expose the outer circumferential surface to the scanning beam passed thorough the space formed above the image development section. Accordingly, it is possible to effectively release the heat from the image development section, and also possible to create an airflow toward the photoconductor.

In the present invention, the photoconductor is of a (endless) cylindrical shape. The cylindrical shape is typified by a drum shape. However, the shape is not limited thereto, but may be of a belt shape. Further, the material and the physical property of the photoconductor is not particularly limited as long as the material and the physical property are adaptable to the electrophotographic process. At the time of image forming, the outer circumferential surface of the photoconductor moves in a single direction (in a second scanning direction). In the case of the photoconductor of the drum shape, the outer circumferential surface moves in response to a rotation of the drum.

The laser scanning section performs laser beam scanning on the outer circumferential surface in its moving direction and also in a direction perpendicular thereto (a first scanning direction), and exposes the outer circumferential surface to the laser beam. A typical configuration of the laser scanning section is such that a laser beam emitted from a fixed laser source is caused to reflect on side surfaces of a rotating polygon mirror to obtain the scanning beam.

Whether the toner used for development is single component type or dual component type is not a matter of consideration. A configuration in which the image development section and the toner storage section are arranged distant from each other is one of the characteristics of the present invention. The image development section is arranged so as to face the outer circumferential surface of the photoconductor in order to perform development on the outer circumferential surface, and is also arranged in a region extending in a first scanning direction. The toner storage section is arranged so as to be separated from the image development section at a predetermined distance. The predetermined distance is a distance which allows the scanning beam to expose the outer circumferential surface through the space formed between the image development section and the toner storage section.

As above described, the scanning beam scans the outer circumferential surface of the photoconductor in the first scanning direction, and thus at least a part of the toner storage section extends approximately in parallel to the first scanning direction, and forms the space between itself and the image development section.

A most serious disadvantage in the case of downsizing the diameter of the photoconductor drum is a decay time (time required until a surface potential of a part exposed to the scanning beam is stabilized). In the case of downsizing the diameter of the photoconductor drum, in order to ensure a predetermined decay time, an angle between the exposure point exposed to the scanning beam and the developing point, the angle being as viewed from the central axis of the photoconductor drum, needs to be set wide.

Although detailed explanation will be given later, in a layout having a vertical transport path, as shown in FIG. 1, the image development section is arranged below the drum. Under such a condition, when the toner storage section is arranged above the image development section, an optical path of the scanning beam is interrupted due to the downsizing of the diameter of the photoconductor drum.

In this configuration, in order to keep the angle between the exposure point and the developing point wide, the cleaner and the charger are arranged at a downstream position from the vertical transport path (a side above the transfer section) so as to locate the exposure point at a higher possible position. On the other hand, the image development section needs to be arranged at an upstream position (a side below the transfer section) from the vertical transport path. However, when the cleaner and the charger are actually arranged, the exposure point is located at a position on the outer circumferential surface of the photoconductor, the position being slightly higher than a horizontal plane including the central axis of the photoconductor.

The toner storage section is preferably arranged above the image development section. This is because such a configuration allows the toner to be supplied to the image development section without defying gravity, and is free from mechanical awkwardness. The simplest arrangement is to arrange the toner storage section immediately above the image development section.

On the other hand, in order to improve the heat releasing property of the image development section, it is preferable to arrange the space for releasing heat in the surrounding area of the image development section. From such a point of view, it is preferable to arrange the toner storage section distant from the image development section. Accordingly, the toner storage section is arranged at an upper side of the image development section so as to have a predetermined distance from the image development section. Further, the laser scanning section is arranged in a lateral direction of the image development section, and the scanning beam is emitted obliquely upward from the horizontal plane so as to expose the outer circumferential surface to the scanning beam passed through the space formed above the image development section, whereby the exposure point can be located at an upper position closer to the charger.

In this manner, the heat releasing property of the image development section and the photoconductor drum is improved, and a predetermined decay time is ensured without having a useless space. Accordingly, it is possible to realize an image forming apparatus capable of being downsized.

Hereinafter, preferred embodiments of the present invention will be described.

The laser scanning section may emit the scanning beam toward a position higher than a central axis of the photoconductor. Accordingly, the scanning beam reflected on the outer circumferential surface returns to the laser scanning section, and thus it is possible to prevent a problem in which the level of the scanning beam is reduced.

Further, the image development section may be configured to allow the toner to come into contact with the peripheral surface in a region which extends along a central axis of the photoconductor, the image forming apparatus may further include a toner transport section which is disposed at one end of the image development section, and which communicates the toner storage section to the image development section, and the toner transport section may transport the toner stored in the toner storage section to the image development section. The toner transport section may be structured in a manner combined with the toner storage section, and may be detachable from the image forming apparatus body including the image development section. Alternatively, the toner transport section is arranged in the image forming apparatus body including the photoconductor, and the toner storage section and the image development section may be detachable from the image forming apparatus body.

Further, the vertical transport path may guide the printing sheet onto which the visualized image is transferred to a fixing section which is disposed downstream of the vertical transport path, and which fixes the toner onto the printing sheet, and then guide the printing sheet to the transfer section after a direction of the printing sheet is reversed at a reverse transport path, so that the printing sheet circulates through the reverse transport path. The above-described various types of preferred embodiments may also be realized in combination with one another.

Hereinafter, the present invention will be described in detail with reference to drawings. Note that the following description illustrates examples of the present invention, and should not construed as limitations to the present invention.

Overall Configuration of an Image Forming Apparatus

Figure 6:
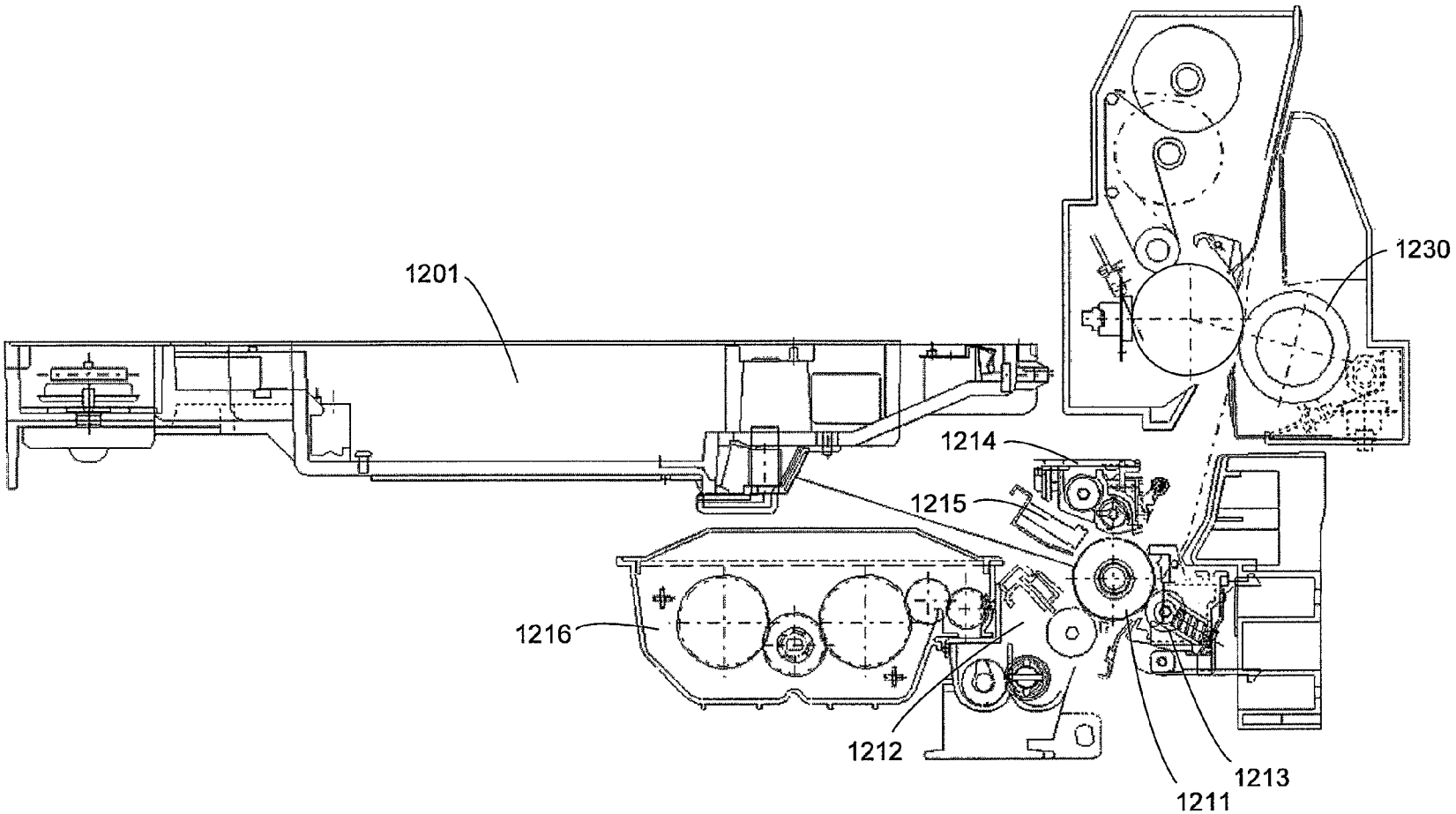
Fig.6 PRIOR ART
FIG. 6 is a diagram schematically showing an arrangement of a developing device, a toner cartridge, and an LSU of a conventional image forming apparatus.

First, an overall configuration of an image forming apparatus according to the present invention will be described. Examples of a photoconductor, a laser scanning section, an image development section, a toner storage section, a vertical transport path, a transfer section, and a toner transport section will be described in detail. FIG. 1 is a diagram schematically showing an overall configuration of the image forming apparatus of the present invention. As shown in FIG. 6, the image forming apparatus generally includes an original copy reading section 100, an image forming apparatus body 200, a post-processing device 300, and a sheet stack section 400.

The original copy reading section 100 is designed to read an original copy (not shown) placed on a transparent original copy table 101, and, for that purpose, includes a scanner optical system 111. An Image of the original copy is converted to an electrical signal (image signal) by a photoelectric conversion element (CHARGE COUPLED DEVICE (CCD)) 115.

The image forming apparatus body 200 is constituted of an image forming section 210, and a feeder and transport section 220. The image forming section 210 forms an image of the original copy in accordance with the image signal. The feeder and transport section 220 causes printing sheets P to be stored in the feeding cassette 221, and sequentially feeds the stored printing sheets P to a first feeding path 225. The printing sheets fed to the first feeding path 225 are then transported to the image forming section 210.

The image forming section 210 has a photoconductor drum 211 for an electrophotographic process. The photoconductor drum 211 corresponds to the photoconductor of the present invention. Arranged in the vicinity of the photoconductor drum 211 are a main charging device 215, the LSU 201 which corresponds to the laser scanning section of the present invention, a developing device 212 which corresponds to the image development section of the present invention, a transfer roller 213 which corresponds to the transfer section, and a cleaning device 214. A toner cartridge 216, which corresponds to the toner storage section of the present invention, is also arranged. At one outer circumferential side of the photoconductor drum 211, the developing device 212 and the toner cartridge 216 are communicated with each other having a toner feeder pipe 217 interposed therebetween. The transfer roller 213 corresponds to the transfer section of the present invention, and the toner feeder pipe 217 corresponds to the toner transport section of the present invention.

The main charging device 215 substantially uniformly charges an outer circumferential surface of the photoconductor drum 211. The photoconductor drum 211 is rotary driven in a direction indicated by an arrow. At a downstream from the main charging device 215 along the indicated direction, there is an exposure point L, on which a laser beam from the LSU 201 is incident. Upon exposure to the laser beam, whose outgoing beam amount is controlled based on the image signal, an electrostatic latent image is formed on the outer circumferential surface of the photoconductor drum 211. The developing device 212 located downstream from the exposure point L changes the formed electrostatic latent image to a visible image (toner image) by using toner. In the present embodiment, dual-component development is applied.

The transfer roller 213 located downstream from the developing device 212 transfers the developed toner image onto a printing sheet P. The transfer roller 213 is disposed halfway along a vertical transport path 226. The printing sheet P passes through resist rollers 229, and has the toner image transferred thereonto by the transfer roller 213 halfway along the vertical transport path 226. The printing sheet P is then transported to fixing rollers 230 disposed at an end of the vertical transport path. The fixing rollers 230 correspond to the fixing section. The vertical transport path 226 corresponds to the vertical transport path of the present invention. The cleaning device 214 disposed downstream from the transfer roller 213 removes toner remaining on the photoconductor drum 211 after transfer. The cleaning device constitutes a part of the vertical transport path 226. As a modified example, a charge neutralization device may be disposed between the transfer roller 213 and the cleaning device 214 so as to remove an electrical charge remaining on the photoconductor drum 211. In that case, instead of the cleaning device 214, the charge neutralization device constitutes the part of the vertical transport path 226.

As above described, the laser beam from the LSU 201 is controlled based on the image signal representing an image of the original copy. However, the image forming apparatus of the present invention is not limited to such a configuration. Instead, the laser beam may be controlled based on print data received from an apparatus such as an external computer (not shown) or the like connected through a communication line, or based on facsimile data received from a FAX machine connected via a public line. In other words, the image forming apparatus may function as a so-called digital multifunction device.

When the printing sheet P having the toner image transferred thereonto by the transfer roller 213 passes through the fixing rollers 230, the toner is fused and adhered to the surface of the printing sheet P. Then the printing sheet P is transported through a sheet transport path 231, a second switching gate 238, a first switching gate 235, a first sheet exit path 233, and sheet exit rollers 232, and is discharged to the first discharge section 234. Alternatively, the printing sheet P is led to a second sheet exit path 301 of the post-processing apparatus 300 by the first switching gate 235 disposed downstream from the fixing rollers 230, and discharged to a first sheet stack tray 401 or a second sheet stack tray 402 in a sheet stack section 400 through an escape path 302 or a staple tray 303.

Further, the feeder and transport section 220 has a reverse transport path 237 disposed in parallel to the sheet transport path 231. The reverse transport path 237 is designed to perform an automatic duplex printing function to print images on both sides of a printing sheet P. At the time of the automatic duplex printing, the printing sheet P having passed through the fixing rollers 230 is once transported to the sheet exit rollers 232. When a tail end of the printing sheet P has passed the second switching gate 238, the printing sheet P is turned in the reversed direction, led by the second switching gate 238 to the reverse transport path 237, and then transported to the resist rollers 229 disposed upstream from the transfer roller 213. Thereafter, the printing sheet P again passes through the transfer roller 213 and has a toner image transferred onto a sheet surface opposite to the side having a toner image previously transferred. The printing sheet P having the toner image transferred thereonto is transported through the fixing rollers 230, and discharged into the first discharge section 234, the first sheet stack tray 401, or the second sheet stack tray 402.

Layout of the Photoconductor and its Surroundings

Next, a layout of the photoconductor and its surroundings will be described. In the image forming apparatus shown in FIG. 1, for the sake of downsizing the apparatus, such a layout is adopted that causes a printing sheet to be vertically transported on the side of the photoconductor drum 211 and also causes the printing sheet to have a toner image transferred thereonto. Further, for the sake of the downsizing, the photoconductor having a smallest possible diameter is arranged. In the present embodiment, the photoconductor has a diameter of 30 mm. In consideration of characteristics of the electrophotographic process, a decay time of the photoconductor is posed as a problem when the diameter of the photoconductor is downsized without changing a process speed (moving speed of the outer circumferential surface of the photoconductor). The decay time is alternatively defined as a traveling time of a point on the outer circumferential surface of the photoconductor drum 211, the point traveling between the exposure point L and a point (developing point) where an electrostatic latent image is caused to be visible by the developing device 212. Under a predetermined process speed condition, the traveling time is determined based on an arc distance between the exposure point L and the developing point along the outer circumferential surface of the photoconductor.

Figure 2:
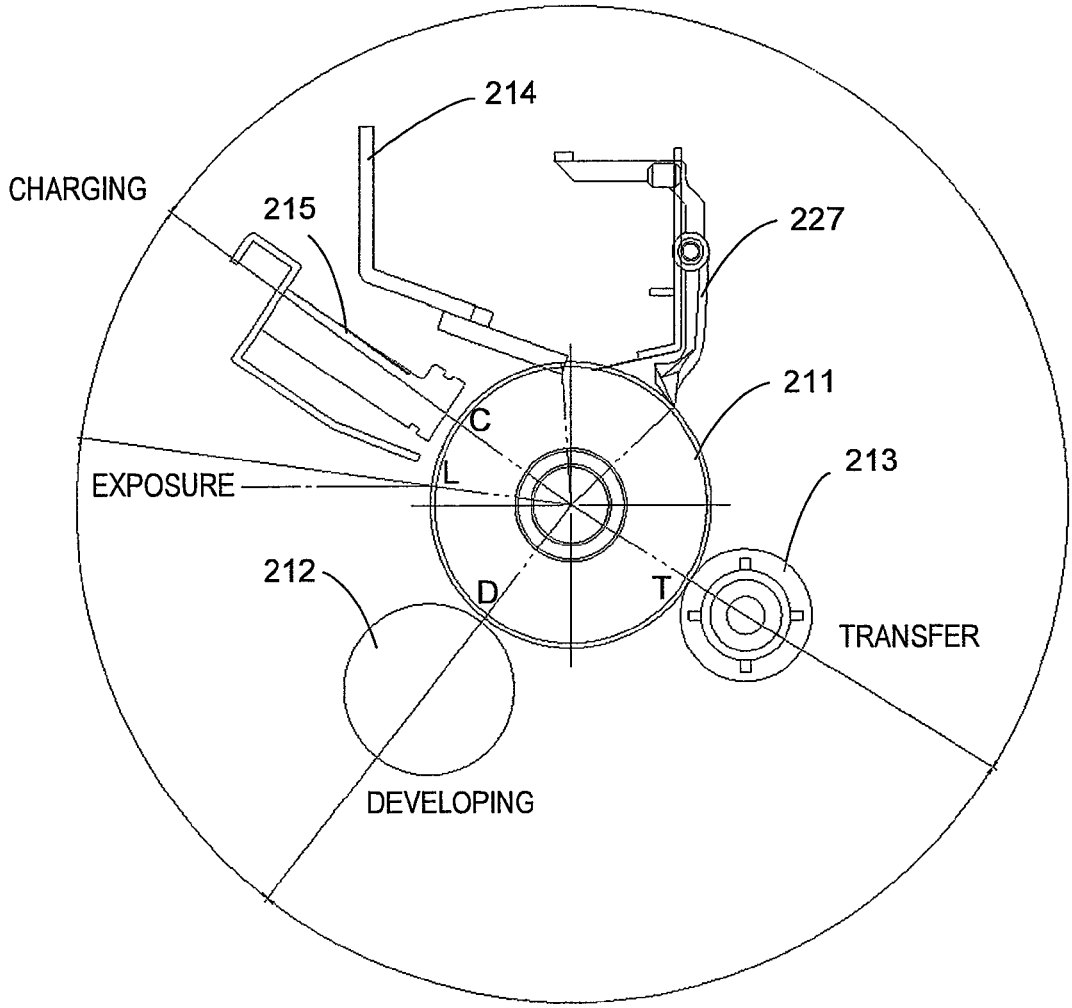
FIG. 2 is a diagram schematically showing respective stations arranged in the vicinity of a photoconductor drum 211 in the image forming apparatus as an embodiment of the present invention.

FIG. 2 is a diagram schematically showing respective stations arranged in the vicinity of the photoconductor drum 211 in the image forming apparatus as an embodiment of the present invention. FIG. 2 shows a shape of the photoconductor drum 211 as viewed from a distant point extending from a rotation axis thereof. FIG. 2 shows an arrangement of the main charging device 215, the developing device 212, the transfer roller 213, and the cleaning device 214. The right side surface of the cleaning device 214 constitutes a part of the vertical transport path 226, and on the surface, a separation claw 227 physically separating the printing sheet P from the photoconductor drum 211 is disposed.

In FIG. 2, the exposure point on the outer circumferential surface of the photoconductor drum 211 is denoted by reference character L, and the developing point is denoted by reference character D. Further, an arc distance between the exposure point L and the developing point D along the outer circumferential surface of the photoconductor drum 211 is denoted by reference character Pld. Still further, a point where electrostatic charging is performed, and a point where transfer is performed, on the outer circumferential surface of the photoconductor drum 211, are denoted by reference characters C and T, respectively.

The decay time is obtained by dividing the distance Pld by the process speed. In order to downsize the diameter of the photoconductor drum 211 without changing the process speed, the arc distance Pld needs to be kept constant even if the diameter of the photoconductor drum 211 is reduced. Accordingly, an angle between the exposure point L and the developing point D as viewed from the rotation axis of the photoconductor drum 211 needs to be set wide.

When the vertical transport path is arranged on the right side of the photoconductor drum 211, positions of the transfer point T and the cleaning device 214 are determined independently of the diameter of the photoconductor drum 211. At the transfer point T, minute toner particles need to be transferred onto the surface of the printing sheet P without having wobbling, halation, and scattering. The transferred yet-to-be-fixed toner then needs to be transported to the fixing rollers 230. Therefore, it is necessary to feed the printing sheet P from the transfer point T to the fixing rollers 230 such that an unnecessary external force is not applied to the printing sheet P during its transport. Inevitably, the vertical transport path is determined to be located at such a path that allows the printing sheet P to travel in a straight line.

When the angle between the exposure point L and the developing point D is increasingly set wider along with the downsizing of the diameter, the developing point D comes increasingly closer to the upstream (lower) side of the vertical transport path 226, whereas the electrostatic charge point C and the exposure point L come increasingly closer to the downstream (upper) side of the vertical transport path 226. However, the cleaning device 214 needs to have its cleaning blade in contact with the outer circumferential surface of the photoconductor drum 211 to form an acute angle therebetween and also needs to have a space to discharge collected toner. Therefore, the downsizing is performed in a limited manner. Further, the developing device 212 needs to have an agitation mechanism and a convection mechanism in order for the toner fed from the toner cartridge 216 to be uniformly supplied to the developing point D. Therefore, the downsizing has limits.

In view of these limited conditions, the exposure point L is limited to a position slightly higher than a horizontal plane including the rotation axis of the photoconductor. Further, the developing point D is limited to a position slightly closer to the exposure point L than a vertical plane including the rotation axis of the photoconductor, as shown in FIG. 2.

Here, a location of the toner cartridge 216 is posed as a problem along with the downsizing of the diameter. It is preferable to arrange the toner cartridge 216 above the image development section such that the toner can be supplied to the image development section without defying gravity.

Figure 3:
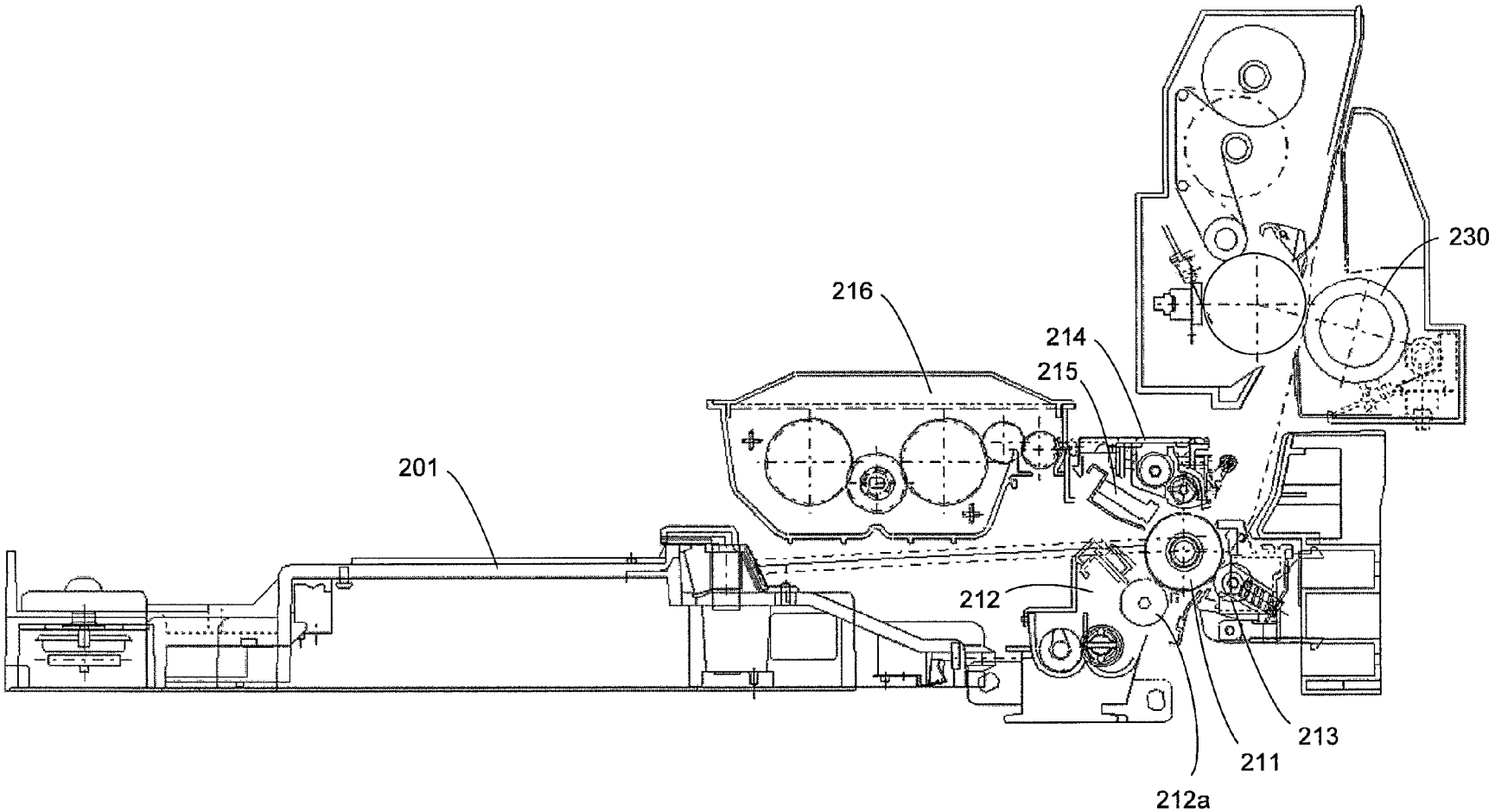
FIG. 3 is a diagram schematically showing an arrangement of a developing device, a toner cartridge and an LSU in the image forming apparatus as an embodiment of the present invention.

FIG. 3 is a diagram schematically showing an arrangement of the developing device 212, the toner cartridge 216, and the LSU 201 in the image forming apparatus according to an embodiment of the present invention. FIG. 3 also shows the arrangement of the photoconductor drum 211, the main charging device 215, the transfer roller 213, and the cleaning device 214 shown in FIG. 2, and the arrangement of the fixing rollers 230. As shown in FIG. 3, the toner cartridge 216 is disposed above the developing device 212, and the toner cartridge 216 and the developing device 212 are separated from each other so as to have a space therebetween. A scanning beam from the LSU 201 travels through the space. The LSU 201 is disposed on the left side of the developing device 212, and the scanning beam is emitted slightly obliquely upward from the horizontal plane. The exposure point is located slightly downstream from the main charging device 215.

Heat Releasing Space Between the Developing Device and the Photoconductor Drum

In the developing device 212, the toner is agitated and moves convectively, and consequently friction heat occurs. In addition, when the automatic duplex printing is performed, a printing sheet, whose first surface undergoes a transfer process and is heated with the fixing rollers 230, passes though the reverse transport path 237, and comes into contact with the photoconductor drum 211 when the second surface undergoes the transfer process. When the automatic duplex printing is performed on a large number of printing sheets, a temperature of the photoconductor drum 211 is gradually increased due to the heat transported by the printing sheets.

The developing device 212 has a developing roller 212*a*. The developing roller 212*a* has a magnet located thereinside, and a magnetic brush is formed on its outer circumferential surface by the action of the magnet. The developing roller 212*a* is located so as to face the outer circumferential surface of the photoconductor drum 211, and the magnetic brush is in contact with the outer circumferential surface of the photoconductor drum 211. When the temperature of the photoconductor drum 211 is increased, the heat is transported to the developing roller 212*a* and a developing agent (toner and carrier) in the developing device through the magnetic brush. Even after printing is completed and the agitation in the developing device 212 stops, the magnetic brush is in contact with the photoconductor drum 211, and the toner is heated by residual heat of the photoconductor drum 211. When such a situation continues for a long period of time, the toner particles are agglomerated inside the developing device 211, which adversely effects print image quality. In order to avoid such a problem, heat releasing performance of the developing device 211 needs to be improved.

As aforementioned, in the present embodiment, the toner cartridge 216 and the developing device 212 are arranged so as to be separated from each other. Since the developing device 212 is surrounded by space, the developing device 212 exerts favorable heat releasing performance. In addition, due to the space, it is possible to create an airflow toward the photoconductor.

In order to soundly understand the characteristics of the present invention, a conventional layout will be shown. FIG. 6 is a diagram schematically showing an arrangement of a developing device, a toner cartridge, and an LSU in a conventional image forming apparatus. In FIG. 6, a photoconductor drum is denoted by reference number 1211, the developing device is denoted by reference number 1212, the toner cartridge is denoted by reference number 1216, and the LSU is denoted by reference number 1201. Further, a main charging device, a transfer roller, a cleaning device, and a fixing roller are denoted by reference numbers 1215, 1213, 1214, and 1230, respectively. A part of the toner cartridge 1216 is in contact with an upper part of the developing device 1212, and an opening is arranged at the contact portion such that toner is poured and supplied from the toner cartridge 1216 to the developing device 1212 through the opening.

Updraft of the air surrounding the developing device 1212 is interrupted by the toner cartridge 1216. In this regard, the image forming apparatus shown in FIG. 3 excels in heat releasing performance since there is a space above the developing device 212. Further, the space above the developing device 212 is also used as a path of the scanning beam. In other words, the limited space surrounding the photoconductor drum 211 is utilized effectively. Further, as will be clear when FIG. 3 is compared with the layout shown in FIG. 1, the LSU 201 located in a space under the first discharge section 234 may be located at a further lower position, which enhances downsizing of the image forming apparatus.

Figure 5A:
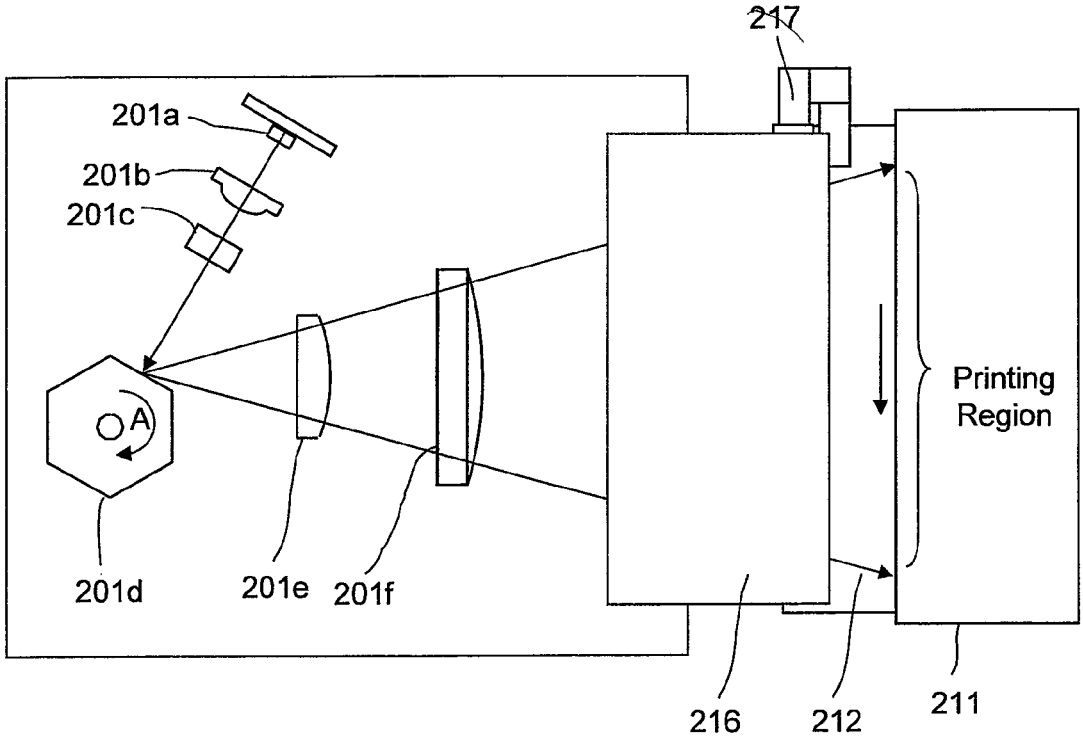
FIGS. 5A and 5B are diagrams schematically showing an internal configuration of the LSU, and an arrangement of the LSU, the developing device, the toner cartridge, and the photoconductor drum according to an embodiment of the present invention.
Figure 5B:
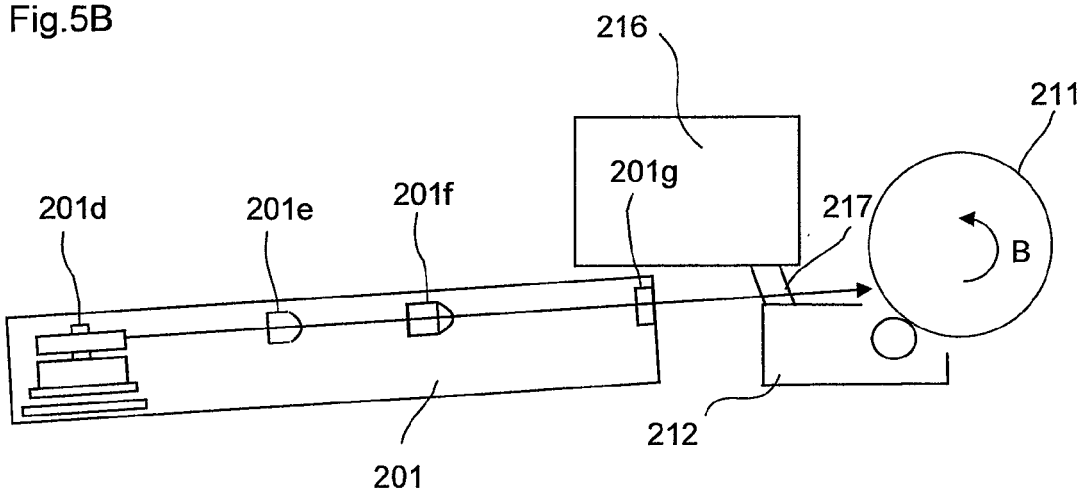

FIGS. 5A and 5B are diagrams schematically showing an internal configuration of the LSU 201, and an arrangement of the LSU 201, the developing device 212, the toner cartridge 216, and the photoconductor drum 211 according to the present embodiment. FIG. 5A shows a top view of the arrangement, whereas FIG. 5B shows a side view of the arrangement. As shown in FIGS. 5A and 5B, a laser beam is emitted from a laser diode 201*a*, which is a laser source. The emitted laser beam is converged by the collimator lens 201*b* in a first scanning direction (approximately horizontal direction), and is then converged by a cylindrical lens 201*c* in a second scanning direction (approximately vertical direction). Thereafter, the laser beam is incident on side mirror surfaces of a rotating polygon mirror 201*d*, and reflected therefrom. The polygon mirror 201*d* rotates at a predetermined speed in a direction as indicated by an arrow A. Due to the rotation of the polygon mirror 201*d*, a reflection angle of the laser beam changes, and the laser beam reflected from the polygon mirror 201*d* will be a scanning beam which is deflected in the first scanning direction. The scanning beam passes through fθ lenses 201*e* and 201*f*, which have fθ characteristics, and also passes through a dust-proof glass 201*g*, and is outputted outside the LSU 201.

The emitted scanning beam travels through the space between the developing device 212 and toner cartridge 216 located thereabove, reaches the photoconductor drum 211, and scans the outer circumferential surface of the photoconductor drum 211 in the first scanning direction, that is, in a direction in parallel to the rotation axis of the photoconductor drum 211. The photoconductor drum 211 is rotary driven in a direction indicated by an arrow B. Upon exposure to the scanning beam, the photoconductor drum 211 has an electrostatic latent image formed on the outer circumferential surface thereof.

Variation in the Exposure Point and Fitting of the LSU

In FIG. 3, a distance between a laser beam emitting part in the LSU 201 and the center of the photoconductor drum 211 is 50 mm. The exposure point is arranged at a position which is on the outer circumferential surface and 2 mm higher than the horizontal plane that includes the rotation axis of the photoconductor. Since positional errors may occur when the image forming apparatus is assembled and the photoconductor drum 211 and the LSU 201 are fitted, an allowable range of variation in the position of the exposure point L in the vertical direction is set to 3 mm in width.

Figure 4A:
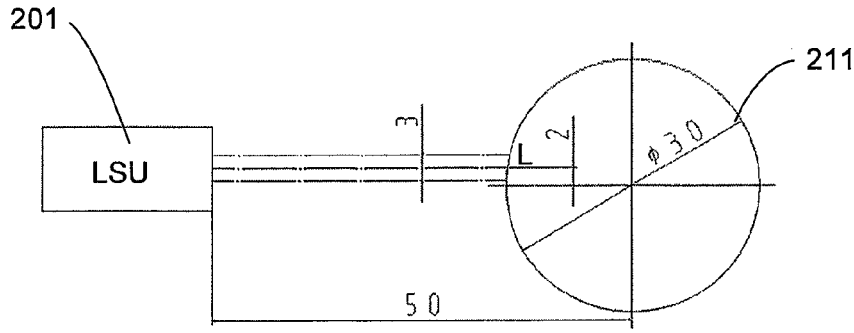
FIGS. 4A, 4B and 4C are diagrams showing an allowable range of variation in an exposure position in an embodiment of the present invention.
Figure 4B:
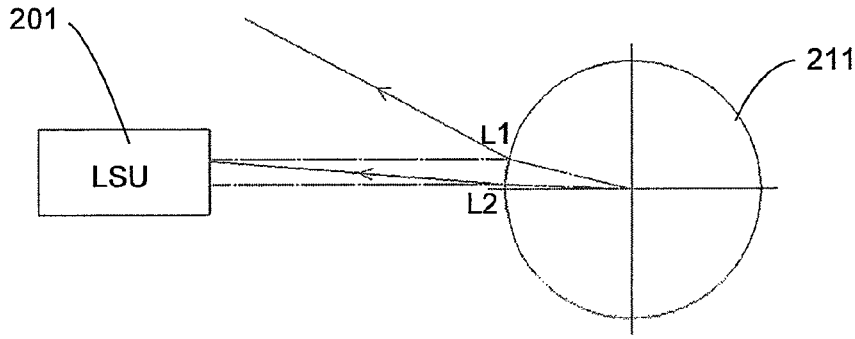
Figure 4C:
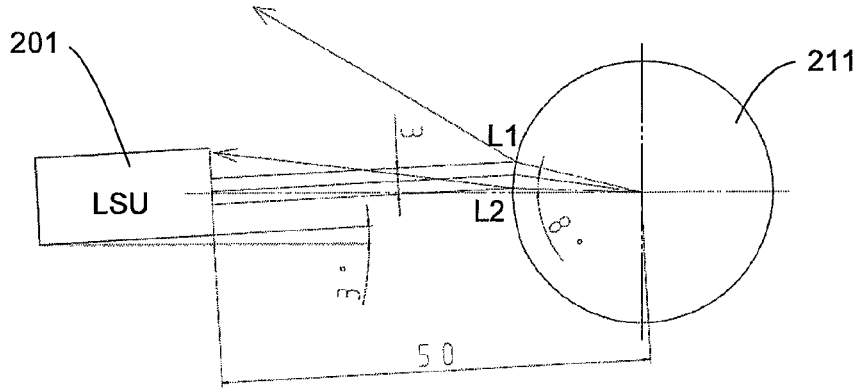

FIGS. 4A, 4B and 4C are diagrams schematically showing an allowable range of variation in the exposure point in an embodiment of the present invention. In FIG. 4A, a standard position of the exposure point is situated at a position 2 mm higher than the horizontal plane that includes the rotation axis of the photoconductor drum 211, and the allowable range of variation in the exposure point L is 3 mm in width having the exposure point L as its center. In consideration of the variation, the space between the developing device 212 and the toner cartridge 216 is determined so as to keep a predetermined distance therebetween.

FIG. 4B indicates a case where a scanning beam is horizontally emitted from the LSU 201, and is incident on a point on the photoconductor drum 211, the point corresponding to an upper limit L1 of the allowable range of variation and also corresponding to the exposure point, and also indicates a case where the scanning beam is emitted from the same position toward the center of the photoconductor drum 211, and incident on a position close to a lower limit L2 of the allowable range of variation, the position corresponding to the exposure point. It is not preferable if the scanning beam reflected from the exposure point L2 on the outer circumferential surface returns to the LSU 201, since stability in the amount of the laser beam cannot be ensured. Therefore, as shown in FIG. 4C, a standard for fitting the LSU is determined such that the scanning beam is emitted from the LSU toward a point that is on the photoconductor drum 211 and slightly higher than the horizontal plane. As an exemplary fitting standard, the LSU is fitted such that the scanning beam is emitted at an angle of 3 degrees upward from the horizontal plane. A maximum tilt angle of the LSU is 5 degrees upward from the horizontal plane. Accordingly, even if the exposure point varies in a range between L1 and L2 due to fitting positional errors, the scanning beam reflected from the outer circumferential surface will not return to the LSU 201. Therefore, it is possible to avoid variation in the amount of the scanning beam, the variation being caused by the reflected scanning beam.

When the scanning beam is emitted slightly upward instead of horizontally, and then the exposure point L spreads at an area above the horizontal plane including the rotation axis of the photoconductor drum 211, a shape of a spot laser beam incident on the outer circumferential surface is not a perfect circle, but is an ellipse which is long in the rotation direction of the photoconductor drum 211. However, as described in the present embodiment, provided that the emission angle is 5 degrees upward from the horizontal plane and that the exposure point L is arranged in the range between the horizontal plane including the rotation axis of the photoconductor drum 211 and the position 3 mm higher from the horizontal plane, then the shape of the scanning beam hardly affects the image quality.

Under the aforementioned conditions (i.e., the tilt angle of the LSU is 5 degrees, and the exposure point is set at the upper limit position), a maximum angle (exposure tilt angle) between the direction in which the scanning beam is incident on the exposure point and a direction perpendicular to the outer circumferential surface at the exposure point is geometrically defined as about 17 degrees. When the exposure tilt angle is increased, the diameter of the beam in the tilting direction is also increased. However, the increase in the diameter of the beam is as small as 4% compared to a case where the exposure tilt angle is 0 degrees. For example, in the case where the diameter of the beam diameter is 70 microns, the increase in the diameter of the beam is as small as about 3 microns. According to empirical data, such a degree of exposure tilt angle does not affect the image quality.

In addition to the above-described embodiment, it is possible to provide variously modified embodiments of the present invention. Those modified embodiments should be construed as being within the scope of the present invention. Further, the present invention should be construed to include anything within the scope of the appended claims, and any and all equivalents and variations within the same scope.

What is claimed is:

1. An image forming apparatus comprising:

a cylindrical photoconductor used for image formation in an electrophotographic process;

a laser scanning section for exposing a peripheral surface of the photoconductor to a scanning beam so as to form an electrostatic latent image thereon;

an image development section for developing the electrostatic latent image by using a toner;

a toner storage section for storing the toner to be supplied to the image development section;

a vertical transport path configured to pass a printing sheet therethrough while the printing sheet comes into contact with a part of the peripheral surface of the photoconductor; and a transfer section for transferring an image that is visualized by the image development section with use of the toner from the peripheral surface of the photoconductor onto the printing sheet, wherein the image development section is disposed in contact with the peripheral surface upstream of a rotation direction of the photoconductor from the transfer section, the toner storage section is disposed above the image development section while having a predetermined distance from the image development section so as to form a space therebetween for releasing heat, and the laser scanning section emits the scanning beam obliquely upwardly with respect to a horizontal direction toward a position higher than a central axis of the photoconductor so that the emitted scanning beam passes through the space, reaches the peripheral surface, and exposes the peripheral surface.

2. The image forming apparatus according to claim 1, wherein the image development section is configured to allow the toner to come into contact with the peripheral surface in a region which extends along a central axis of the photoconductor, the image forming apparatus further comprises a toner transport section which is disposed at one end of the image development section, and which communicates the toner storage section to the image development section, and the toner transport section transports the toner stored in the toner storage section to the image development section.

3. The image forming apparatus according to claim 1, wherein the vertical transport path guides the printing sheet onto which the visualized image is transferred to a fixing section which is disposed downstream of the vertical transport path, and which fixes the toner onto the printing sheet, and then guides the printing sheet to the transfer section after a direction of the printing sheet is reversed at a reverse transport path, so that the printing sheet circulates through the reverse transport path.

* * * * *